US005899801A

United States Patent [19]

Tolles et al.

[11] Patent Number: 5,899,801

[45] Date of Patent: May 4, 1999

[54] METHOD AND APPARATUS FOR REMOVING A SUBSTRATE FROM A POLISHING PAD IN A CHEMICAL MECHANICAL POLISHING SYSTEM

[75] Inventors: Robert D. Tolles, Santa Clara; James C. Nystrom, Palo Alto; Jeffrey Marks, San Jose; William Bartlett, Los Gatos; Victor Belitsky, Sunnyvale, all of Calif.

[73] Assignee: Applied Materials, Inc., Santa Clara, Calif.

[21] Appl. No.: 08/741,662

[22] Filed: Oct. 31, 1996

[51] Int. Cl.[6] ..... B24B 1/00; B24B 29/00

[52] U.S. Cl. ..... 451/288; 156/345; 216/89; 438/692

[58] Field of Search ..... 156/345 LP; 438/692; 216/89; 451/288

[56] References Cited

U.S. PATENT DOCUMENTS 3,913,271 10/1975 Boettcher ..... 51/5 R
5,245,790 9/1993 Jerbic ..... 51/55
5,246,525 9/1993 Sato ..... 156/345
5,423,716 6/1995 Strasbaugh ..... 451/388
5,498,199 3/1996 Karlsrud et al. ..... 451/289
5,527,209 6/1996 Volodarsky et al. ..... 451/388

*Primary Examiner*—Bernard Dentz
*Attorney, Agent, or Firm*—Fish & Richardson

[57] ABSTRACT

A chemical mechanical polishing apparatus has a platen with a cavity with an opening to the top surface of the platen. A polishing pad is located at an upper surface of the platen. A flexible membrane is positioned in the cavity to define a first and a second volume. A pressure source is connected to the second volume to flex the membrane, and a lifting member is positioned in the first volume so that flexing of the membrane extends the lifting member through the opening to lift the substrate off the polishing pad. Alternately, de-ionized water may be forced through a passage in the platen and an aperture in the polishing pad to lift the substrate.

13 Claims, 10 Drawing Sheets

100
102
84
108
320
315
300
34
36
38
39
32
30
150
152
289
282
278
294
292
284
262
290
286
234
242
232
288
258
230
306
264
254
240
304
268
266
276
274
144
104
10
270
272
281
218
220
226

100
102
84
144
104
108
258
10
300'
34
36'
38'
39
32
30
150
152
289
330
288
242
240
254
286
290
292
234
232
230
306
304
284
262
294
282
278
264
268
266
276
274
270
272
218
281
220
226

METHOD AND APPARATUS FOR REMOVING A SUBSTRATE FROM A POLISHING PAD IN A CHEMICAL MECHANICAL POLISHING SYSTEM

BACKGROUND OF THE INVENTION

The present invention relates generally to chemical mechanical polishing of substrates, and more particularly to a method and apparatus for removing a substrate from the surface of a polishing pad in a chemical mechanical polishing system.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes increasingly non-planar. This non-planar outer surface presents a problem for the integrated circuit manufacturer. If the outer surface of the substrate is non-planar, then a photo-resist layer placed thereon is also non-planar. A photo-resist layer is typically patterned by a photolithographic apparatus that focuses a light image onto the photoresist. If the outer surface of the substrate is sufficiently non-planar, the maximum height difference between the peaks and valleys of the outer surface may exceed the depth of focus of the imaging apparatus. Then it will be impossible to properly focus the light image onto the entire outer surface. Therefore, there is a need to periodically planarize the substrate surface to provide a flat surface for photolithography.

Chemical mechanical polishing (CMP) is one accepted method of planarization. This planarization method typically requires that the substrate be mounted on a carrier or polishing head. The exposed surface of the substrate is then placed against a rotating polishing pad. The carrier head provides a controllable load, i.e., pressure, on the substrate to push it against the polishing pad. In addition, the carrier head may rotate to provide additional motion between the substrate and polishing surface.

A polishing slurry, including an abrasive and at least one chemically-reactive agent, may be supplied to the polishing pad to provide an abrasive chemical solution at the interface between the pad and the substrate. CMP is a fairly complex process, and it differs from simple wet sanding. In a CMP process, the reactive agent in the slurry reacts with the outer surface of the substrate to form reactive sites. The interaction of the polishing pad and abrasive particles with the reactive sites on the substrate results in polishing.

An effective CMP process has a high polishing rate and generates a substrate surface which is finished (lacks small-scale roughness) and flat (lacks large-scale topography). The polishing rate, finish and flatness are determined by the pad and slurry combination, the relative speed between the substrate and pad, and the force pressing the substrate against the pad. The polishing rate sets the time needed to polish a layer. Because inadequate flatness and finish can create defective substrates, the selection of a polishing pad and slurry combination is usually dictated by the required finish and flatness. Given these constraints, the polishing time needed to achieve the required finish and flatness sets the maximum throughput of the CMP apparatus.

One problem encountered in the CMP process is the difficulty in removing the substrate from the polishing pad surface once polishing has been completed. As mentioned above, a thin layer of slurry is supplied to the surface of the polishing pad. When the substrate is placed in contact with the polishing pad, the surface tension of the slurry generates an adhesive force which binds the substrate to the polishing pad. The adhesive force makes it difficult to remove the substrate from the pad at the end of the polishing operation.

Typically, the carrier head is used to remove the substrate from the polishing pad. The substrate is vacuum-chucked to the underside of the carrier head. When the carrier head is retracted from the polishing pad, the substrate is lifted off of the polishing pad. However, if the surface tension holding the substrate on the polishing pad is greater than the force holding the substrate on the carrier head, then when the carrier head retracts, the substrate will remain on the polishing pad. This may cause the substrate to fracture or chip. In addition, failure to remove the substrate can cause a machine fault requiring manual intervention by the integrated circuit manufacturer. This requires shutting down the polishing apparatus, decreasing throughput. To achieve reliable operation from the polishing apparatus, the substrate removal operation should be essentially flawless.

Several techniques have been employed to reduce the surface tension between the substrate to the polishing pad. One such technique is to slide the substrate horizontally off of the polishing pad to break the surface tension before vertically retracting the carrier head. This technique may, however, damage the substrate as the substrate may detach from the carrier head as it slides off the edge of the polishing pad. The mechanical configuration of the CMP apparatus may also prohibit this technique.

Another technique is to treat the surface of the polishing pad to reduce the surface tension. However, this technique is not always successful, and the alteration of the pad surface may adversely affect the finish and flatness of the substrate, and reduce the polishing rate.

In view of the foregoing, there is a need for a chemical mechanical polishing apparatus which reliably removes the substrate from the polishing pad surface.

SUMMARY OF THE INVENTION

In one aspect, the invention is directed to a chemical mechanical polishing apparatus. The apparatus has a platen and a polishing pad located at an upper surface of the platen. The apparatus also has a means to lift a substrate on the polishing pad by applying an upward force to an underside of the substrate through an opening in the upper surface of the platen.

In another aspect, the apparatus has a lifting member which is movable between a first position in which a top surface of the polishing pad is substantially planar and a second position in which the lifting member forms a projection at the top surface of the polishing pad.

In another aspect, the apparatus has a lifting member which is movable between a first position in which the lifting member is recessed beneath a top surface of the polishing pad and a second position in which the lifting member extends through an opening in the upper surface of the platen to lift a substrate away from the top surface of the polishing pad.

Implementations of the invention may include the following. The apparatus may have a carrier for positioning the substrate on the polishing pad, and the carrier may include a chucking mechanism to hold the substrate. The opening may be located approximately at the center of the platen. The platen may include a cavity, and a flexible membrane may be disposed in the cavity to form first and second volumes within the cavity. A pressure source may increase the pressure in the second volume. The lifting member may be at least partially disposed in the cavity. Specifically, the lifting member may be positioned in the first volume, above the flexible membrane. In the second position, the lifting member may extend through the opening to engage the underside of the polishing pad and lift a portion thereof away from the upper surface of the platen. The polishing pad may have an aperture positioned above the opening, and, in the second position, the lifting member may project through the opening and the aperture to extend above the top surface of the polishing pad. The polishing pad may include an upper layer and a lower layer, and, in the second position, the lifting member may protrude through an aperture in the lower layer to contact the upper layer of the polishing pad. The polishing pad may be attached to the platen with an adhesive, but an area on the upper surface of the platen around the opening may be free of the adhesive.

In another aspect, the invention is directed to a method of removing a substrate from a polishing pad. A substrate is positioned on a polishing pad above a lifting member. The lifting member is actuated to form a projection at a top surface of the polishing pad. A force is applied to hold the substrate against a mounting surface of a carrier, and the mounting surface is lifted away from the polishing pad.

In another aspect, a substrate is positioned on a polishing pad located at the top surface of a platen. The substrate is vacuum-chucked to a mounting surface of a carrier. An upward force is applied to an underside of the substrate through an opening in the top surface of the platen, and the mounting surface is lifted away from the polishing pad.

Implementations of the invention may include the following. An edge of the substrate may be positioned above the lifting member. The substrate may be positioned above the lifting member before or after the lifting member is actuated. A portion of the polishing pad may be lifted with the lifting member to form the projection. The lifting member may be retracted.

In another aspect, the invention is directed to a chemical mechanical polishing apparatus including a fluid source connected to a passageway through a platen to apply a lifting force to a substrate on a top surface of a polishing pad. The apparatus also includes a carrier head to which the substrate may be chucked, and a controller operable to cause the carrier head to chuck the substrate to the mounting surface and to cause a fluid to flow through an aperture in the polishing pad to lift the substrate from the polishing pad.

Implementations of the invention include the following. The polishing pad may include an upper layer and a lower layer, with the aperture passing through the upper layer and lower layer. The lower layer may include a non-porous insert surrounding the aperture. An inner surface of the passageway through the platen may be coated with a polyvinylidene fluoride material. The fluid may be a liquid such as substantially pure de-ionized water or an aqueous solution of potassium hydroxide.

In another aspect, the invention is directed to a method of removing a substrate from a polishing pad in a chemical mechanical polishing apparatus. A substrate is positioned above an aperture in a polishing pad. A fluid is caused to flow through the aperture to apply an upward force to an underside of the substrate, and the substrate is chucked to a mounting surface of a carrier. The mounting surface of the carrier is lifted away from the polishing pad as the fluid flows through the aperture.

Advantages of the invention include the following. A dechucking mechanism reliably removes the substrate from the surface of the polishing pad. The dechucking mechanism applies a mechanical force sufficient to break the surface tension created by slurry. There is minimal danger of damage to the substrate during the dechucking process. When not in use, the dechucking mechanism may retract to provide a smooth polishing pad surface. The dechucking mechanism may be incorporated into any configuration of a chemical mechanical polishing apparatus. The polishing pad may easily be modified to accommodate the invention.

Other advantages of the invention will be set forth in the description which follows, and in part will be obvious from the description, or may be learned by practice of the invention. The advantages of the invention may be realized by the instrumentalities and combinations particularly pointed out in the claims.

BRIEF DESCRIPTION OF THE DRAWINGS

The accompanying drawings which are incorporated in and constitute a part of the specification, schematically illustrate embodiments of the invention, and together with the general description given above and the detailed description of the embodiments given below, serve to explain the principles of the invention.

DETAILED DESCRIPTION OF THE PREFERRED EMBODIMENT(S)

Figure 1:
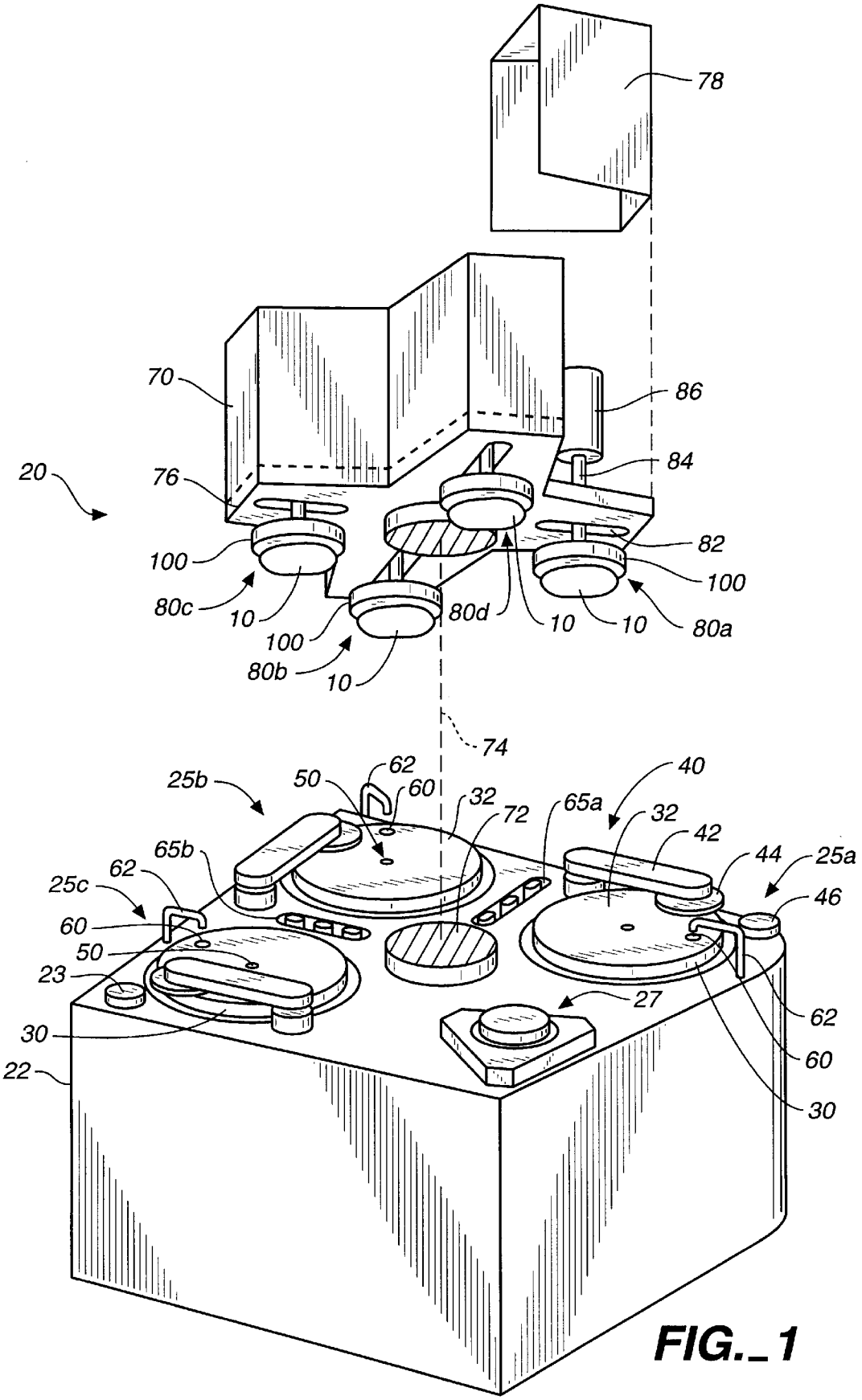
FIG. 1 is a schematically exploded perspective view of a chemical mechanical polishing apparatus.

Referring to FIG. 1, one or more substrates 10 will be polished by a chemical mechanical polishing apparatus 20. A complete description of polishing apparatus 20 may be found in U.S. patent application Ser. No. 08/549,336, now abandoned, entitled RADIALLY OSCILLATING CAROUSEL PROCESSING SYSTEM FOR CHEMICAL MECHANICAL POLISHING, filed Oct. 27, 1995 by Ilya Perlov, et al., and assigned to the assignee of the present invention, the entire disclosure of which is incorporated herein by reference. According to the present invention, polishing apparatus 20 includes a lower machine base 22 with a table top 23 mounted thereon and a removable outer cover (not shown). Table top 23 supports a series of polishing stations 25*a*, 25*b* and 25*c*, and a transfer station 27. Transfer station 27 forms a generally square arrangement with the three polishing stations 25*a*, 25*b* and 25*c*. Transfer station 27 serves multiple functions, including receiving individual substrates 10 from a loading apparatus (not shown), washing the substrates, loading the substrates into carrier heads (to be described below), receiving the substrates from the carrier heads, washing the substrates again, and finally, transferring the substrates back to the loading apparatus.

Each polishing station 25*a*–25*c* includes a rotatable platen 30 on which is placed a polishing pad 32. If substrate 10 is an eight inch (200 millimeter) diameter disk, then platen 30 and polishing pad 32 will be about twenty inches in diameter. Platen 30 is preferably a rotatable aluminum or stainless steel plate connected to a platen drive motor (see FIG. 3). For most polishing processes, the platen drive motor rotates platen 30 at thirty to two hundred revolutions per minute, although lower or higher rotational speeds may be used.

Each polishing station 25*a*–25*c* may further include an associated pad conditioner apparatus 40. Each pad conditioner apparatus 40 has a rotatable arm 42 holding an independently-rotating conditioner head 44 and an associated washing basin 46. The conditioner apparatus maintains the condition of the polishing pad so it will effectively polish any substrate pressed against it while it is rotating. Each polishing station also includes a lifting or substrate dechucking mechanism 50, described in detail below.

A slurry 60 containing a reactive agent (e.g., deionized water for oxide polishing), abrasive particles (e.g., silicon dioxide for oxide polishing) and a chemically-reactive catalyzer (e.g., potassium hydroxide for oxide polishing) is supplied to the surface of polishing pad 32 by a slurry supply tube 62. Sufficient slurry is provided to cover and wet the entire polishing pad 32. Two or more intermediate washing stations 65*a* and 65*b* are positioned between neighboring polishing stations 25*a*, 25*b* and 25*c*. The washing stations rinse the substrates as they pass from one polishing station to another.

A rotatable multi-head carousel 70 is positioned above lower machine base 22. Carousel 70 is supported by a center post 72 and is rotated thereon about a carousel axis 74 by a carousel motor assembly located within base 22. Center post 72 supports a carousel support plate 76 and a cover 78. Multi-head carousel 70 includes four carrier head systems 80*a*, 80*b*, 80*c*, and 80*d*. Three of the carrier head systems receive and hold substrates, and polish them by pressing them against the polishing pads 32 on platens 30 of polishing stations 25*a*–25*c*. One of the carrier head systems receives a substrate from and delivers a substrate to transfer station 27.

The four carrier head systems 80*a*–80*d* are mounted on carousel support plate 76 at equal angular intervals about carousel axis 74. Center post 72 allows the carousel motor to rotate the carousel support plate 76 and to orbit the carrier head systems 80*a*–80*d* and the substrates attached thereto about carousel axis 74.

Each carrier head system 80*a*–80*d* includes a carrier or carrier head 100. Each carrier head 100 independently rotates about its own axis. A carrier drive shaft 84 connects a carrier head rotation motor 86 to carrier head 100 (shown by the removal of one quarter of cover 78). There is one carrier drive shaft and motor for each head. In addition, each carrier head 100 independently laterally oscillates in a radial slot 82 formed in carousel support plate 76. A slider (not shown) supports each drive shaft 84 in radial slot 82. A radial drive motor (not shown) may move the slider to laterally oscillate the carrier head.

The carrier head 100 performs several mechanical functions. Generally, the carrier head holds the substrate against the polishing pad, evenly distributes a downward pressure across the back surface of the substrate, transfers torque from the drive shaft to the substrate, and ensures that the substrate does not slip out from beneath the carrier head during polishing operations.

Figure 2:
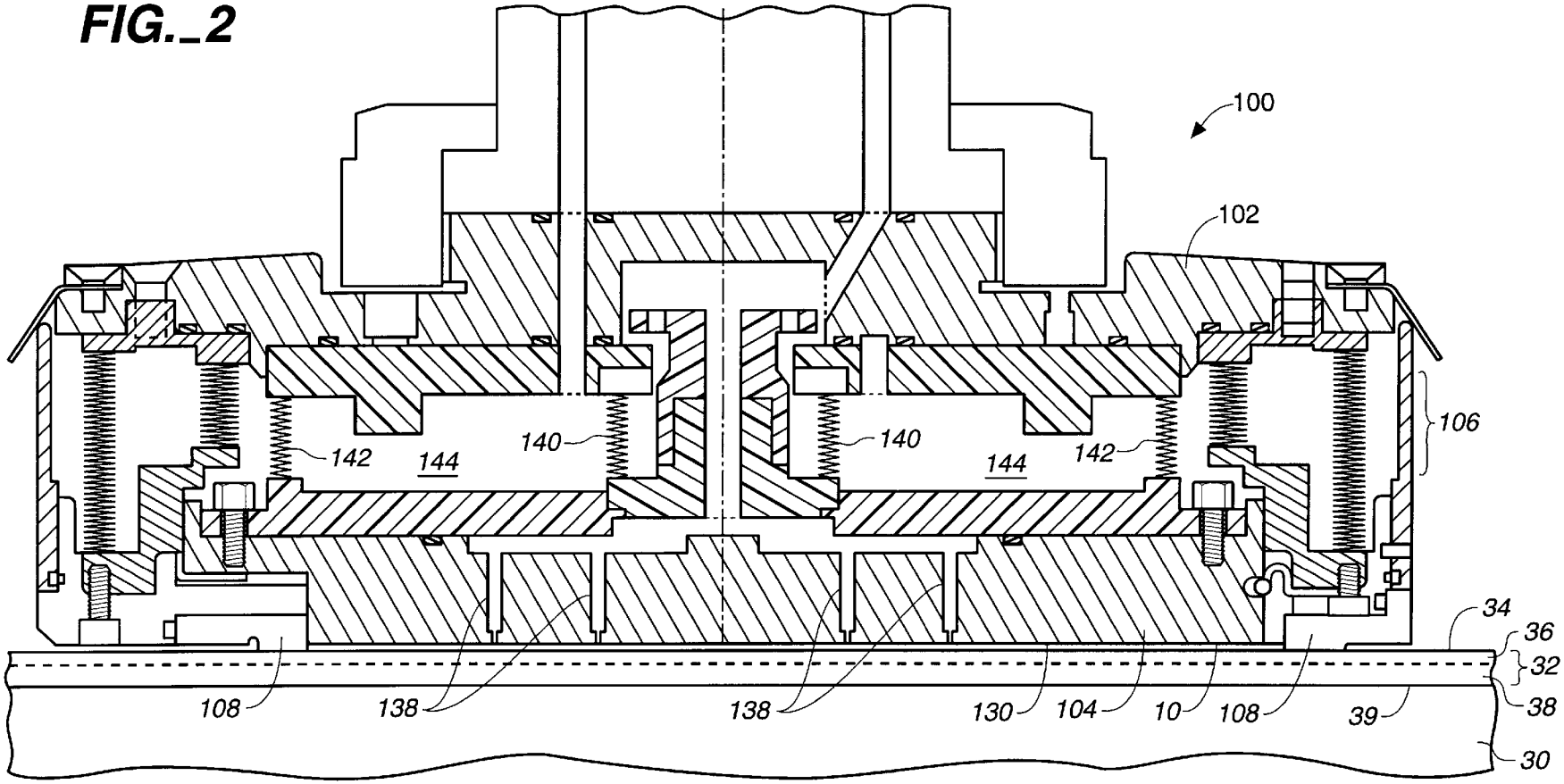
FIG. 2 is a schematically cross-sectional view of a carrier head and a polishing pad.

Referring to FIG. 2, each carrier head 100 includes a housing assembly 102, a base assembly 104 and a retaining ring assembly 106. A loading mechanism may connect base assembly 104 to housing assembly 102. A complete description of carrier head 100 may be found in U.S. patent application Ser. No. 08/549,651, now U.S. Pat. No. 5,681,215 entitled CARRIER HEAD DESIGN FOR A CHEMICAL MECHANICAL POLISHING APPARATUS, filed Oct. 27, 1995 by Michael T. Sherwood et al., assigned to the assignee of the present invention, the entire disclosure of which is incorporated herein by reference.

An inner bellows 140 and an outer bellows 142 connect base assembly 104 to housing assembly 102. The ring-shaped space between the inner and outer bellows forms a pressure chamber 144. A pump (not shown) may pump air into or out of pressure chamber 144. If air is pumped into pressure chamber 144, the volume of pressure chamber 144 will increase, and base assembly 104 and substrate 10 will be forced downwardly against polishing pad 32. If air is pumped out of pressure chamber 144, then the volume of pressure chamber 144 will decrease, and base assembly 104 will be lifted away from polishing pad 32.

Carrier head 100 may also include a chucking or ejection mechanism to hold the substrate to a bottom surface 130 of base assembly 104. The base assembly 104 includes a plurality of conduits 138 which connect to a bottom surface 130. A second pump (not shown) may pump air into or out of conduits 138. If air is pumped out of the conduits, the substrate will be vacuum-chucked to the bottom surface of the carrier head. If air is pumped into the conduits, the substrate will be pressure-ejected from the bottom surface of the carrier head.

As discussed above, carrier head 100 forces the substrate against and lifts the substrate away from polishing pad 32. The polishing pad may be a hard composite material having a roughened polishing surface 34. Polishing pad 32 may be attached to platen 30 by a pressure-sensitive adhesive layer 39. Polishing pad 32 may have a fifty mil thick hard upper layer 36 and a fifty mil thick softer lower layer 38. Upper layer 36 is preferably a material composed of polyurethane mixed with fillers. Lower layer 38 is preferably a material composed of felt fibers mixed with urethane. A common two layer polishing pad, with the upper layer composed of IC-1000 and the lower layer composed of SUBA-4, is available from Rodel, Inc. located in Newark, Del. (IC-1000 and SUBA-4 are product names of Rodel, Inc.).

Figure 3:
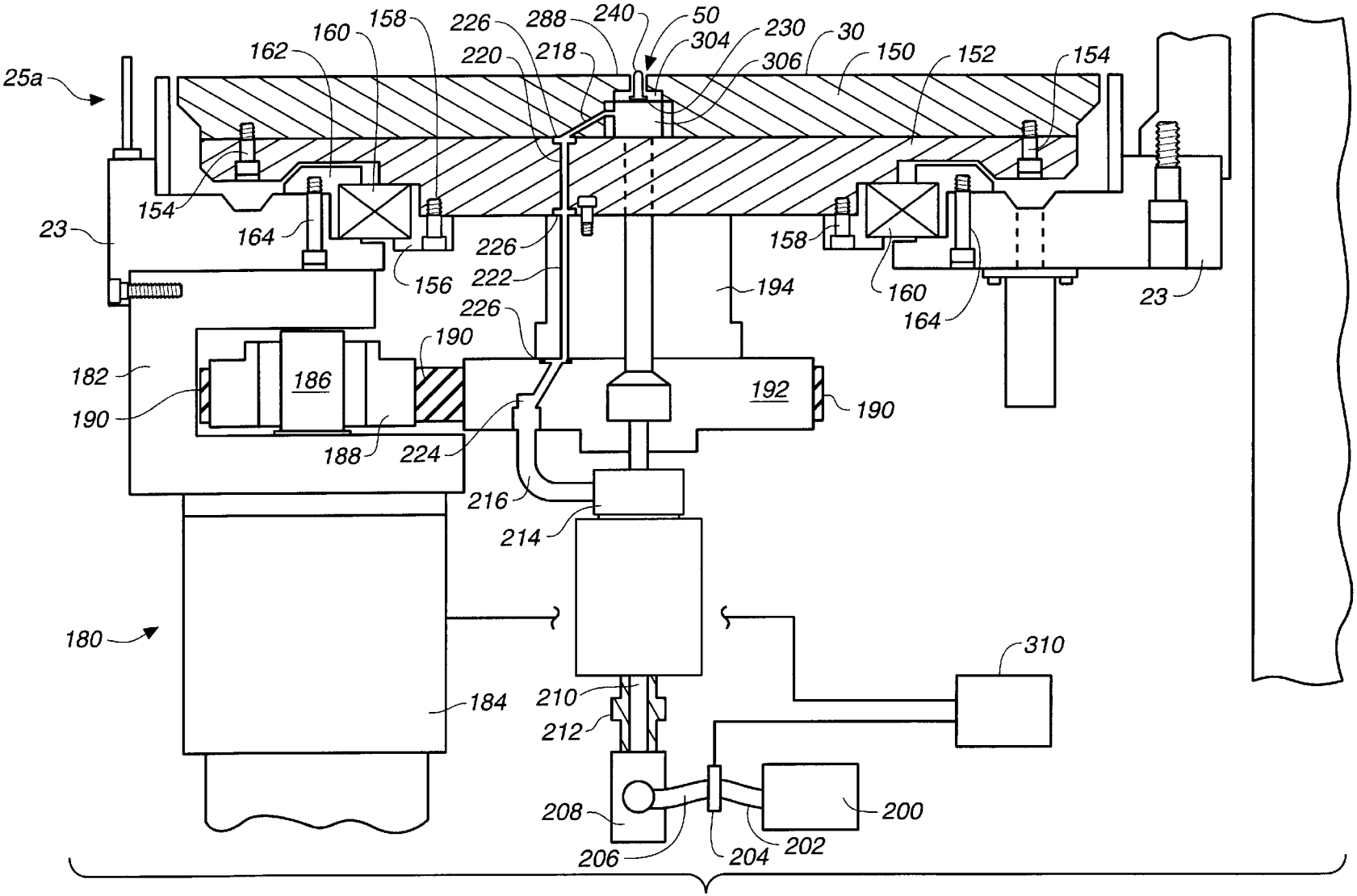
FIG. 3 is a schematically cross-sectional view of a platen assembly including a mechanical dechucking mechanism in accordance with the present invention.

Referring to FIG. 3, each polishing station, such as polishing station 25*a*, includes a lifting or substrate dechucking mechanism 50. Substrate dechucking mechanism 50 applies an upward force to the underside of the substrate. This upward force lifts the substrate off of the surface of the polishing pad and breaks the surface tension so that the carrier head may remove the substrate from the polishing pad.

In brief, the substrate dechucking mechanism includes movable lifting member positioned in a cavity in the platen. The lifting member can move between a rest position and an actuated position. In the rest position, the lifting member is recessed beneath the top surface of polishing pad. In the actuated position, the lifting member extends through an opening in the upper surface of the platen to lift the substrate away from the top surface of the polishing pad.

Platen 30 includes a platen top portion 150 and a platen base portion 152 joined by several peripheral screws 154 counter-sunk into the bottom of platen base 152. A first collar 156 is connected by screws 158 to the bottom of platen base 152 to capture the inner race of an annular bearing 160. A second collar 162, connected to table top 23, by a set of screws 164, captures the outer race of annular bearing 160. Annular bearing 160 supports platen 30 above table top 23 while permitting the platen to be rotated by the platen drive motor.

A platen motor assembly 180 is bolted to the bottom of table top 23 through a mounting bracket 182. Platen motor assembly 180 includes a motor 184 with an output shaft 186. Output shaft 186 is fitted to a solid motor sheath 188. A drive belt 190 winds around motor sheath 188 and a hub sheath 192. Hub sheath 192 is joined to platen base 152 by a platen hub 194. Thus, motor 184 may rotate platen 30. Platen hub 194 is sealed to lower platen base 152 and to hub sheath 192.

Substrate dechucking mechanism 50 may be powered by a stationary pneumatic source 200 such as a pump or a source of pressurized gas. Pneumatic source 200 is connected by a fluid line 202 to a computer controlled valve 204. The computer controlled valve 204 is connected by a second fluid line 206 to a rotary coupling 208. The rotary coupling 208 connects the pneumatic source 200 to an axial passage 210 in a rotating shaft 212, and a coupling 214 connects axial passage 210 to a flexible pneumatic line 216.

Substrate dechucking mechanism 50 is connected to flexible pneumatic line 216 via an angled passage 218 through platen top 150, a vertical passage 220 in platen base 152, a vertical passage 222 in platen hub 194, and a passageway 224 in hub sheath 192. O-rings 226 may be used to seal each passageway.

A programmed computer 310 is appropriately connected to valve 204, platen motor 184, carrier head rotation motor 86, and the radial drive motor (not shown). Programmed computer 310 can open or close valve 204, rotate platen 30, rotate carrier head 100 and move carrier head along slot 82.

Figure 4:
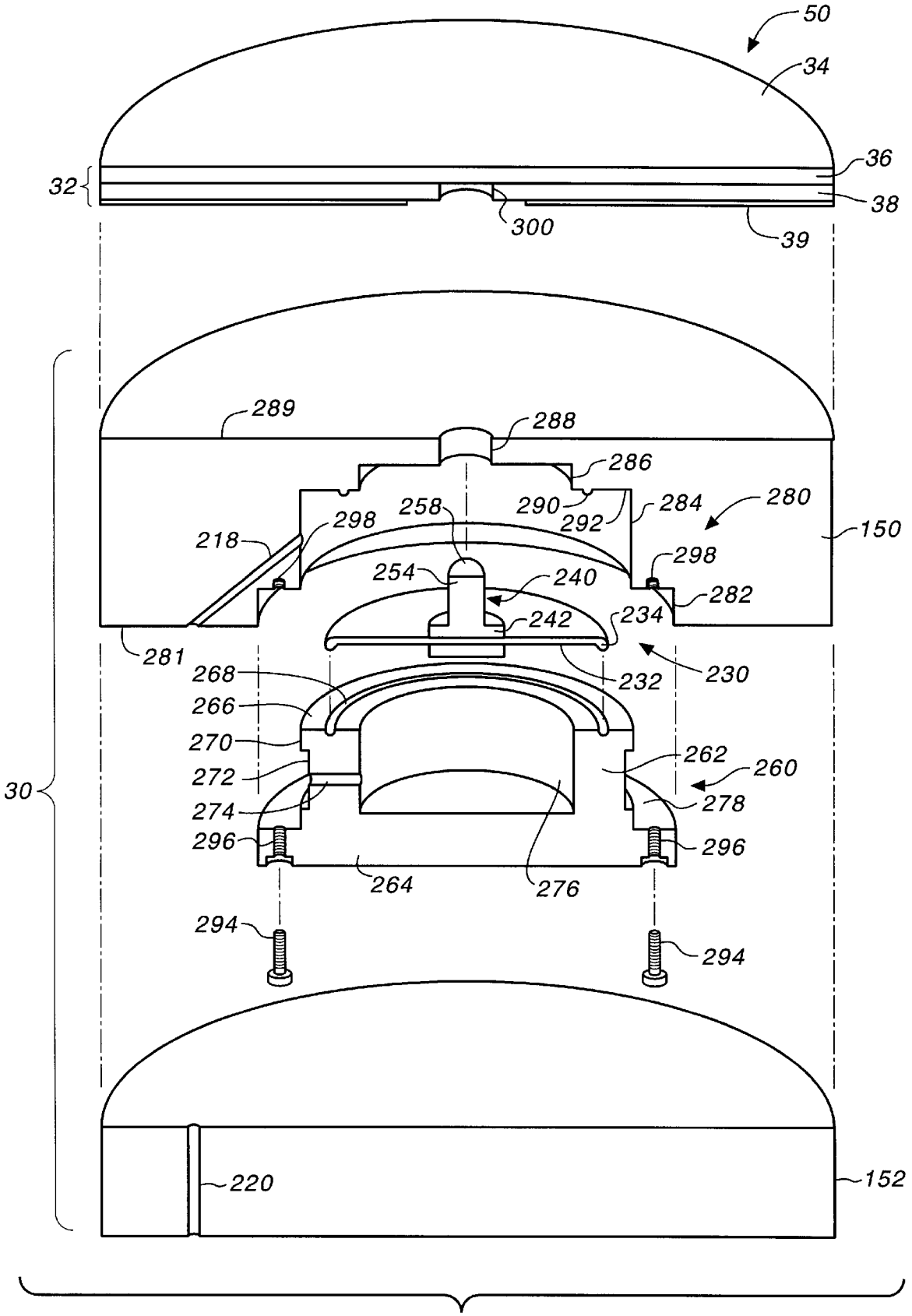
FIG. 4 is an exploded, perspective and partially cross-sectional view of the substrate dechucking mechanism of FIG. 3.
Figure 5:
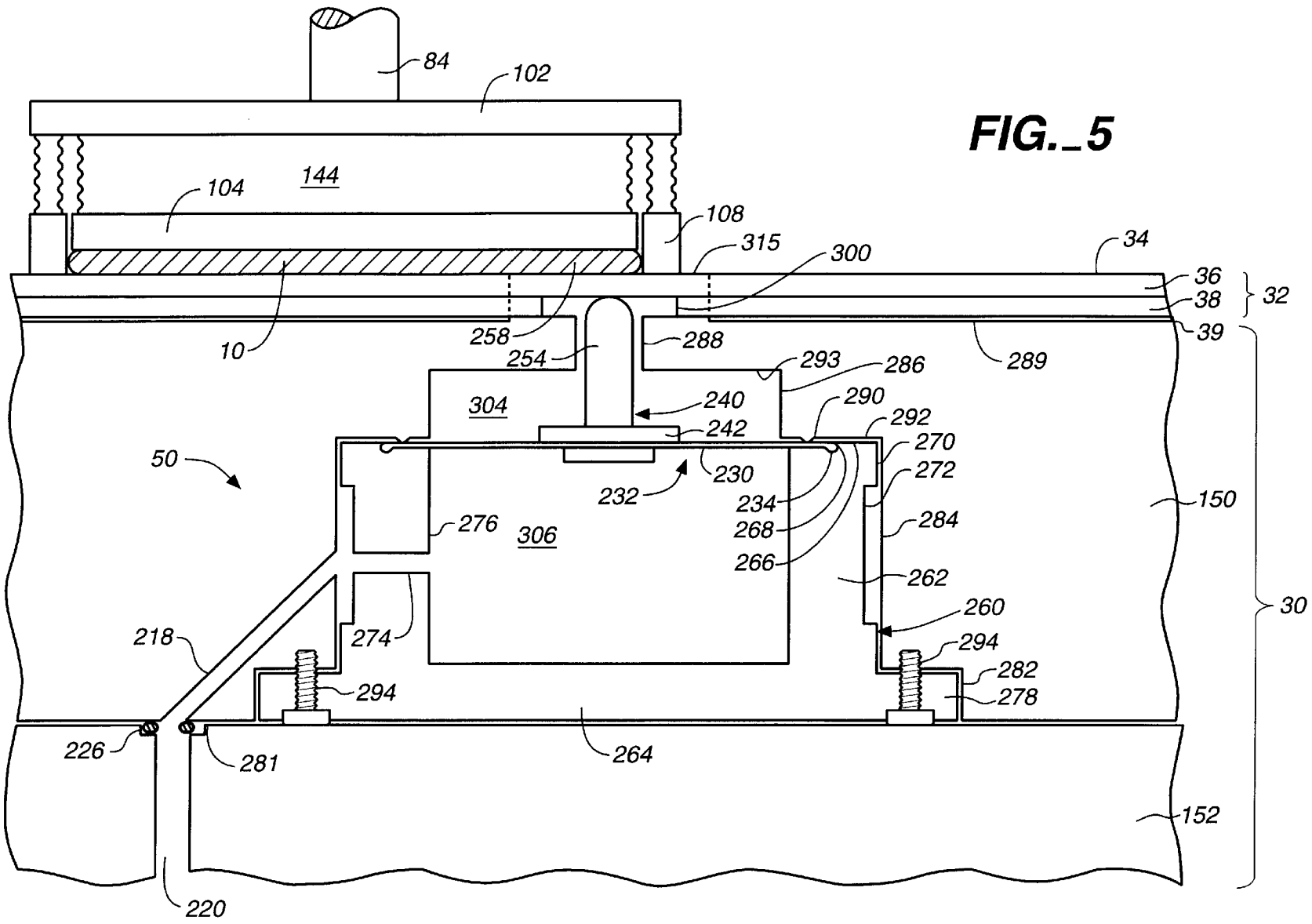
FIG. 5 is an enlarged cross-sectional view of the substrate dechucking mechanism of FIG. 3.

Referring to FIGS. 4 and 5, substrate dechucking mechanism 50 includes a flexible seal 230, a lifting member or bumper 240 and a seal cover plate 260. In brief, seal 230 is held against platen top portion 150 by seal cover plate 260 to form a first volume 304 above the seal and a second volume 306 below the seal. The bumper is placed in the first volume, air is forced into the second volume by pneumatic source 200, via passageway 210, for instance, to flex the seal and cause bumper 240 to move vertically upward. The vertical movement of the bumper creates a projection at the top surface of the polishing pad to lift the substrate.

Figure 7:
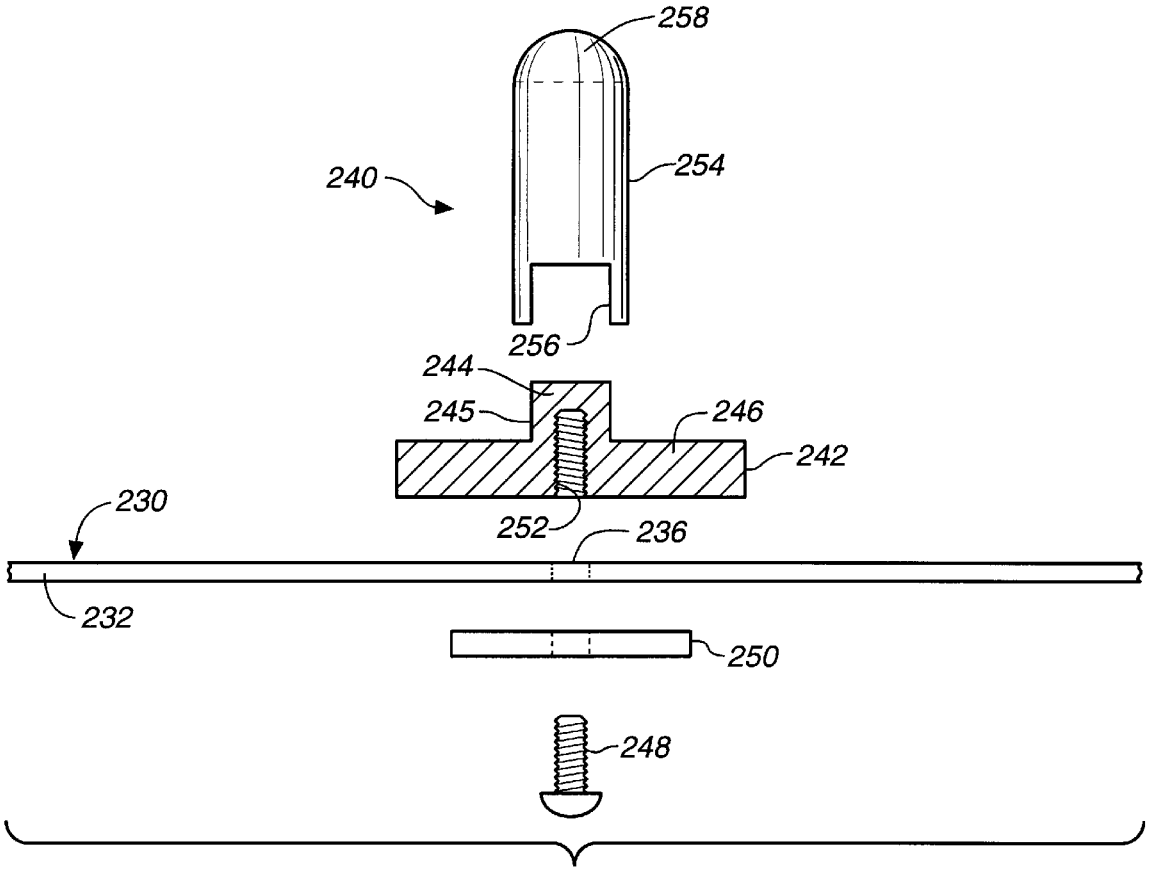
FIG. 7 is an exploded and cross-sectional view of a bumper of the substrate dechucking mechanism of FIG. 4.

Seal 230 may be a circular membrane having a protruding edge 234. Seal 230 may be formed of a flexible material such as rubber. Referring to FIG. 7, an aperture 236 may be found at the center of seal 230.

Bumper 240 may include a cylindrically shaped plunger 254 and a backing piece 242. Bumper 240 may be attached to the center of the seal. Backing piece 242 may have a cylindrical portion 244 and a radically-extending flange 246. The flange 246 of backing piece 242 is placed against seal 230. A screw 248 is inserted through a washer 250 and aperture 236 and into a threaded bore 252 in backing piece 242 to firmly attach the backing piece to the seal. Plunger 254 may be slip-fit onto cylindrical portion 244 of backing piece 242. Plunger 254 may be approximately three-eighths of an inch in diameter. A top surface 258 of plunger 254 may have a hemispherical shape. Alternatively, it may have a flat shape or it may emulate the curvature of the projection to be created in polishing pad 32. Top surface 258 may, for example, be formed of hard or soft rubber, plastic or metal.

Referring again to FIGS. 4 and 5, seal cover plate 260 includes a cylindrical body portion 262 which projects upwardly from a base portion 264. An annular upper surface 266 of cylindrical body 262 may include a circular groove 268, and an outer surface 270 of cylindrical body 262 may include an annular recess 272. One or more channels 274 may extend through cylindrical body 262 to connect annular recess 272 to an interior surface 276. Base portion 264 has a diameter larger than that of cylindrical body 262. Thus, base portion 264 projects beyond body portion 262 to form a radially-extending flange 278 at the bottom of the seal cover plate.

A multi-tiered recess 280 may be formed in platen top 150 to receive seal cover plate 260. Multi-tiered recess 280 may include an outer recess 282 having a diameter approximately the same as that at flange 278, a middle recess 284 having a diameter approximately the same as that of the outer surface of cylindrical body 262 and an inner recess 286 having a diameter approximately the same as that at the inner surface of cylindrical body 262. A cylindrical opening or passage 288 may connect inner recess 286 and a top surface 289 of platen top 150. A circular ridge 290 may project downwardly from an annular area 292 between inner recess 286 and middle recess 284. Angled passage 218 may extend between bottom surface 281 of platen top 150 and middle recess 284.

Substrate dechucking mechanism 50 is assembled by placing seal 230 with attached bumper 240 onto annular surface 266 of seal cover plate 260. The protruding edge portion 234 of seal 230 may fit into groove 268 in surface 266. Then, seal cover plate 260 is inserted into multi-tiered recess 280 so that cylindrical body portion 262 fits in middle recess 284 and flange 278 fits in outer recess 282. Seal cover plate 260 is firmly attached to platen top 150 by inserting screws 294 through holes 296 in flange 278 and into threaded receiving holes 298 in platen top 150. Seal 230 is pinched between circular ridge 290 and surface 266 of cylindrical body 262 to form first volume 304 above the seal and second volume 306 below the seal. Bumper 240 is positioned in first volume 304 and extends into passageway 288 so that its top surface 258 contacts, as discussed below, polishing pad 32. As configured, passageway 288, first volume 304 and second volume 306 form a cavity in platen 30.

Lower layer 38 of polishing pad 32 may have a circular hole 300 positioned above passageway 288 in platen top 150. The hole in lower layer 38 may be approximately three eighths of an inch in diameter to permit bumper 240 to pass through the lower layer and contact upper layer 36. The adhesive layer 39 may be removed in a circular region approximately one to three inches in diameter surrounding passage 288 so that polishing pad 32 may be lifted or deflected without resistance. Alternately, the adhesive layer may be covered with a thin non-adhesive layer, such as an annular mylar sheet, in a circular region surrounding passage 288. Slurry on the top surface 34 of polishing pad 32 cannot penetrate upper layer 36. Thus, the slurry can not contaminate dechucking mechanism 50.

Figure 8:
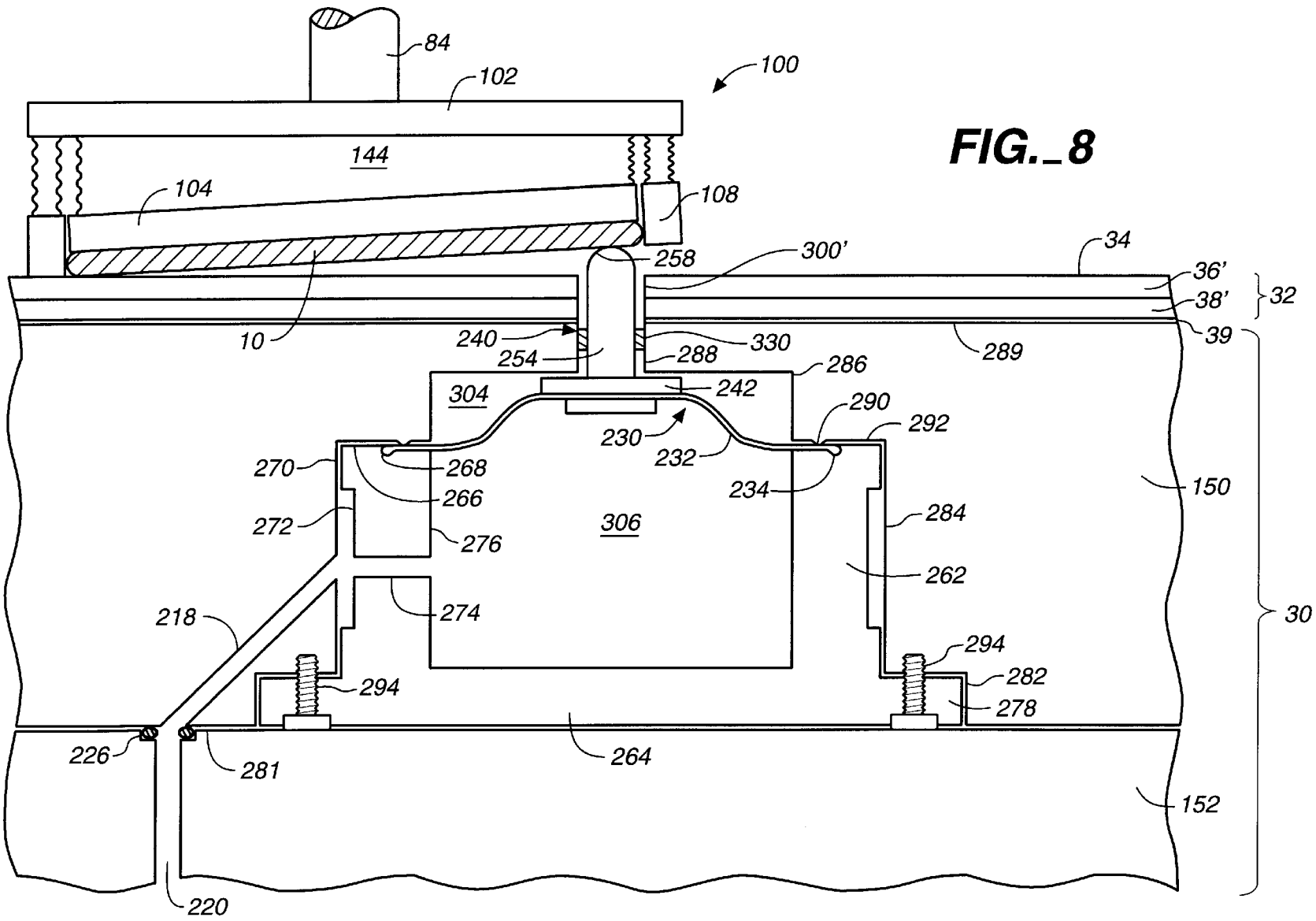
FIG. 8 is a view of a wafer dechucking mechanism in which a bumper extends through an aperture in the polishing pad.

In an alternate implementation, as shown in FIG. 8, hole 300' could extend through upper layer 36' and lower layer 38' to permit top surface 258 of bumper 240 to directly contact substrate 10. In such an implementation, the bumper should be sealed with a seal 330 to the edges of passageway 288' to prevent slurry from contaminating the substrate dechucking mechanism.

In yet another implementation, polishing pad 32 does not have hole 300. Instead, bumper 240 contacts the bottom surface of lower layer 38 of the polishing pad. In such an implementation, bumper 240 deflects both layers of the polishing pad.

Figure 6:
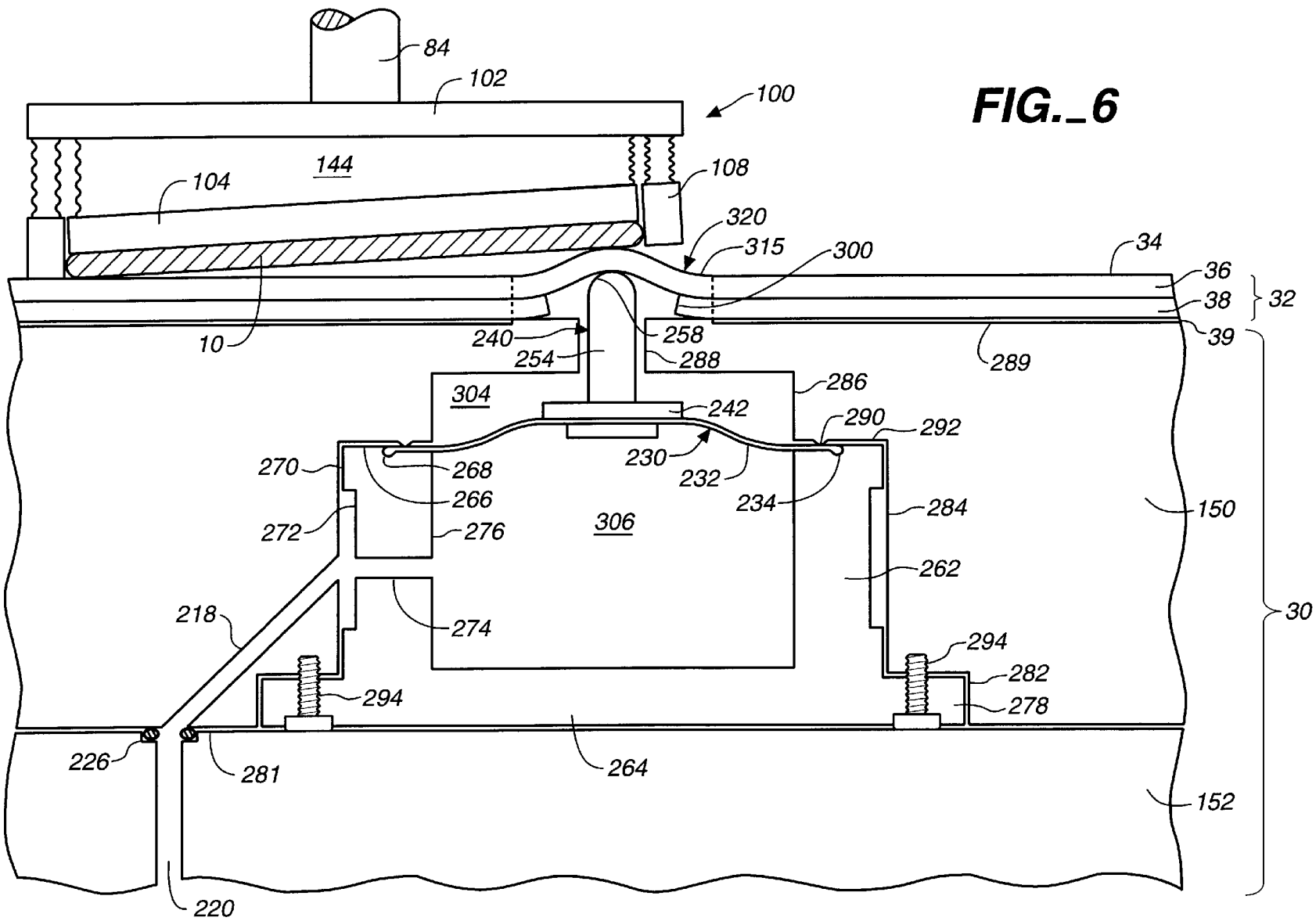
FIG. 6 is a view of the wafer dechucking mechanism of FIG. 5 in which a bumper is extended to remove the substrate from the surface of the polishing pad.

Referring to FIG. 6, in order to detach substrate 10 from the surface of polishing pad 32, computer 310 causes valve 204 to open. Air passes through fluid lines 202 and 206, axial passage 210, flexible pneumatic line 216, passageway 222, passage 224, vertical passage 220, angled passage 218, and channel 274 into second volume 306. The pneumatic source 200 increases the pressure inside second volume 306, and seal 230 bows outwardly to force bumper 240 upwardly into contact with polishing pad 32. A portion 315 of polishing pad 32 is therefore deflected upwardly to form a projection or bump 320. The height of bump 320 may be controlled by selecting the length of plunger 254. The backing piece 242 may catch against an annular area 293 between passageway 288 and inner recess 286 to stop the upward travel of bumper 240. Bumper 240 may undergo a vertical actuation of about one-tenth of an inch.

To lift substrate 10 from polishing pad 32, carrier head 100 moves substrate 10 so that the edge of the substrate is positioned on polishing pad portion 315. The substrate dechucking mechanism is activated to create bump 320. As such, bump 320 lifts the edge of the substrate away from the polishing pad, overcoming surface tension of the slurry.

Computer 310 may open valve 204 to form bump 320 either before or after substrate 10 is positioned above polishing pad portion 315. If bump 320 is formed before the substrate is positioned above polishing pad portion 315, then carrier head 100 will move horizontally to drive the substrate up the slope of bump 320. If the edge of substrate 10 is positioned above polishing pad portion 315 before valve 204 is opened, then substrate dechucking mechanism 50 lifts the edge of the substrate away from polishing pad 32. In either case, substrate 10 is vacuum-chucked to bottom surface 130 of carrier head 100. Then, air is then pumped out of pressure chamber 144 to retract base assembly 104 and lift substrate 10 away from polishing pad 32. The edge of the substrate may be positioned on the slope of bump 320 or at the peak of bump 320 when the carrier head retracts and lifts the substrate away from the polishing pad.

After substrate 10 is removed from polishing pad 32, computer 310 closes valve 204, and seal 230 returns to its original position and bumper 240 retracts beneath polishing pad 32. After the substrate dechucking mechanism is deactivated, the top surface of the polishing pad returns to its substantially plainer condition. Thus, the entire polishing pad can be used by conditioner head 44 or carrier head 100.

As shown, substrate dechucking mechanism 50 may be located at the center of platen 30. Programmed computer 310 causes the carrier head to move along radial slot 82 until the edge of the substrate is over the center of the platen. Then, as noted, the programmed computer causes valve 240 to open to produce an upward deflecting in a portion of the polishing pad. The dechucking mechanism, however, could be located at any spot on the platen. The computer would then cause the platen to rotate to bring the substrate dechucking mechanism into the appropriate position vis-a-vis the substrate.

Many configurations of the substrate dechucking mechanism are possible. For example, an enclosed second volume 306 could be located in the platen base and the bumper could extend through the platen top. The bumper could rest above seal 230 rather than be attached to the seal. The enclosed volume need not be cylindrical. Passage 218 could enter the enclosed volume directly adjacent the seal. Passage 218 could enter first volume 304 above the seal, and a pump could be used to depressurize the first volume to draw the seal upwardly by suction.

Figure 9:
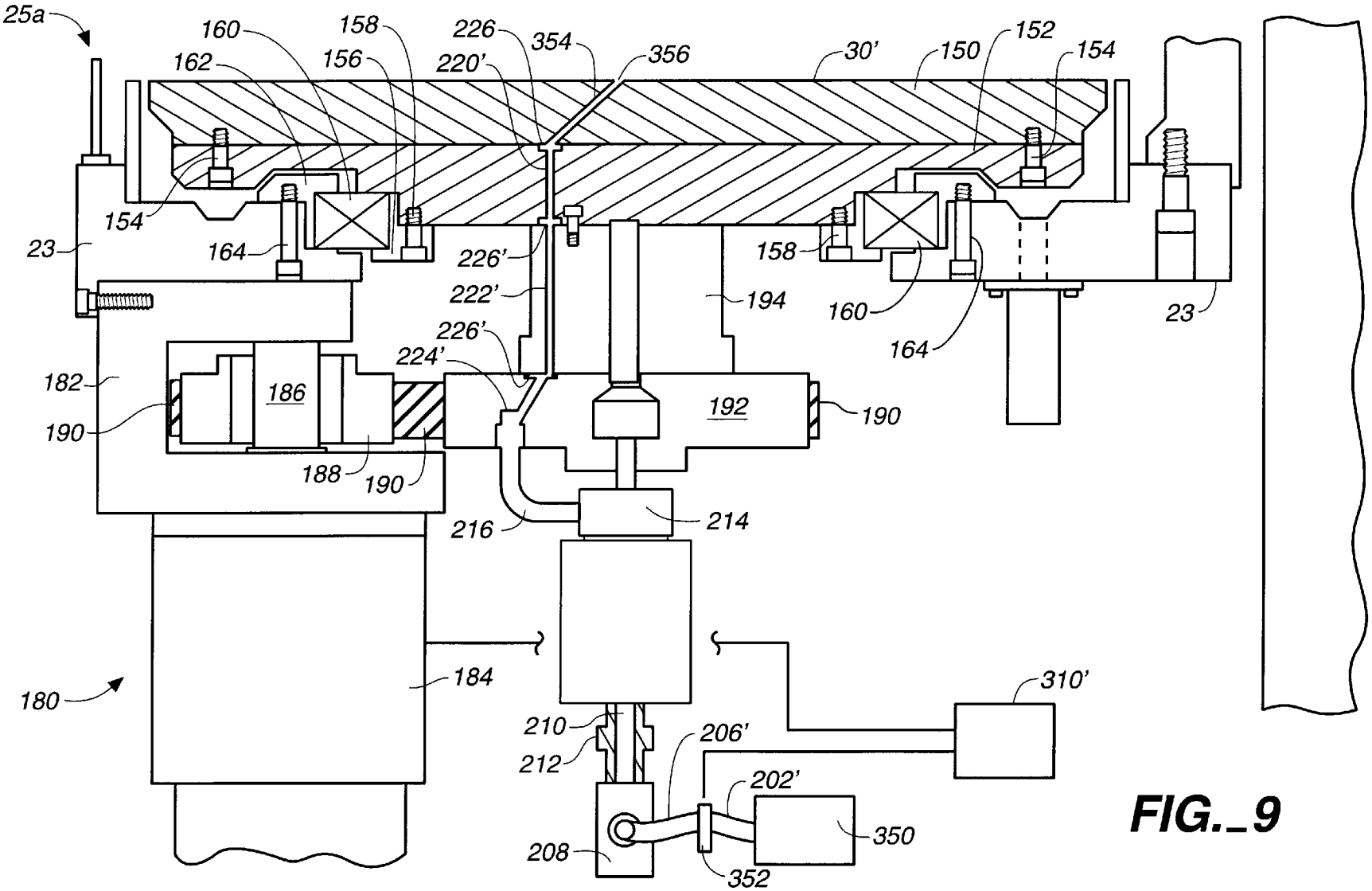
FIG. 9 is a schematically cross-sectional view of a platen assembly including a fluid-pressure dechucking mechanism in accordance with the present invention.
Figure 10:
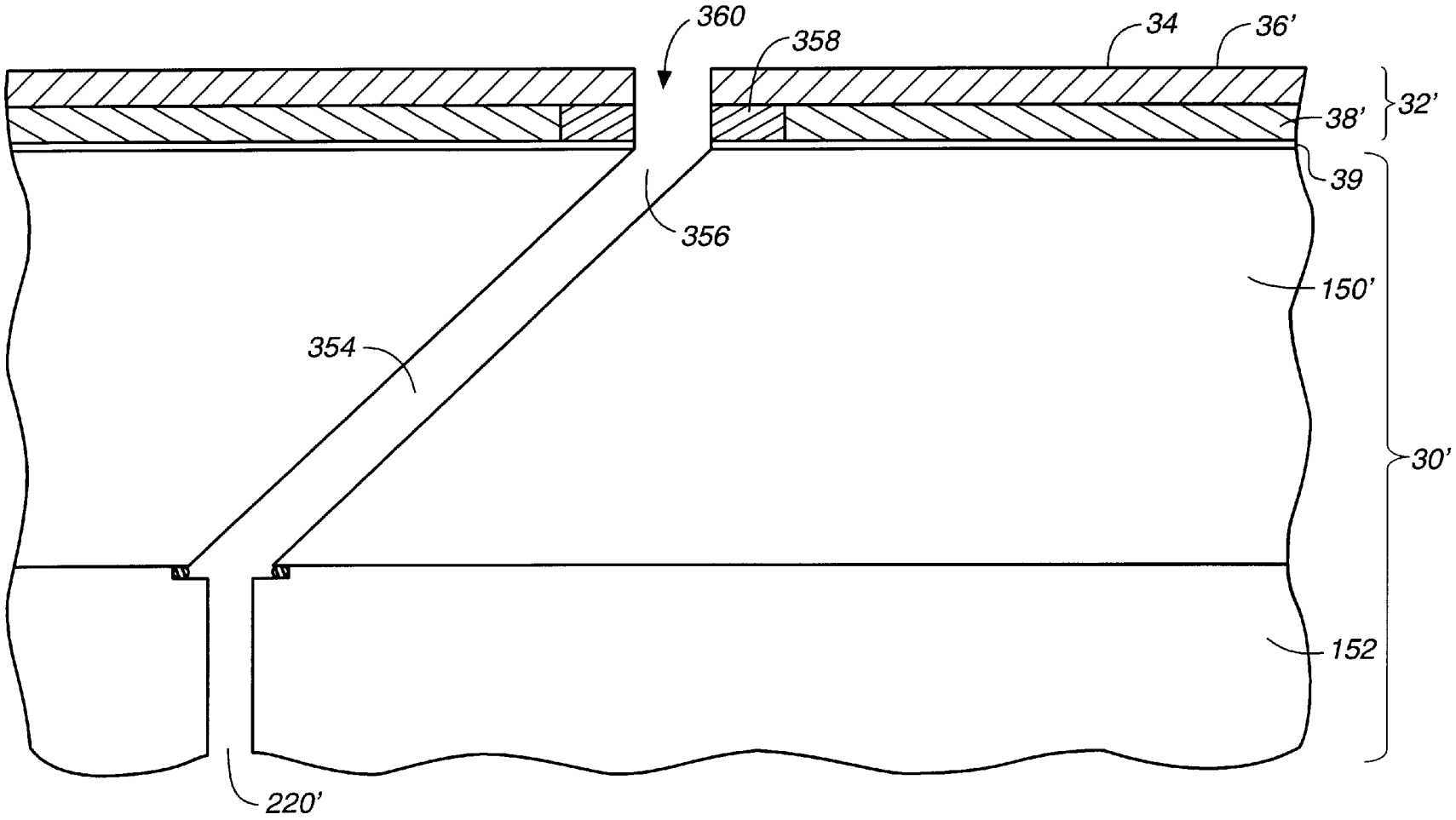
FIG. 10 is an enlarged cross-sectional view of the substrate dechucking mechanism of FIG. 9.

In another embodiment, shown in FIGS. 9 and 10, the substrate dechucking mechanism uses a pressurized fluid, instead of a mechanical lifting member, to lift the substrate. The modified elements of the embodiment shown in FIGS. 9 and 10 are referred to with primed numbers.

Referring to FIG. 9, the substrate dechucking mechanism includes a fluid source 350. Preferably, the fluid is a liquid, such as substantially pure de-ionized water or an aqueous solution of potassium hydroxide, which does not interfere with the polishing operation. Fluid source 350 is connected by a fluid line 202' to a computer controlled valve 352. The computer controlled valve 352 is connected by a second fluid line 206' to rotary coupling 208. The fluid source 350 may be a pressurized fluid source, such as a regulated line. Alternately, fluid source 350 may be a non-pressurized fluid source, and valve 352 may be replaced by a positive displacement pump to deliver fluid at a predetermined flow rate. The rotary coupling 208 connects pressurized fluid source 350 to axial passage 210 in rotating shaft 212, and coupling 214 connects axial passage 210 to flexible fluid line 216.

An opening 356 in the top surface of platen 30' is connected to flexible pneumatic line 216 via an angled passage 354 through platen top 150', a vertical passage 220' in platen base 152, a vertical passage 222' in platen hub 194, and a passageway 224' in hub sheath 192. O-rings 226 may be used to seal each passageway. In addition, the inner surfaces of angled passage 354, vertical passage 220', vertical passage 222', and passageway 224' may be coated with a polyvinylidene fluoride (PVDF) material, such as KYNAR™, available from Pennwalt Corp. of Buffalo, N.Y.

Referring to FIG. 10, an aperture 360 extends through upper layer 36' and lower layer 38' of polishing pad 32' to connect the top surface of the polishing pad to opening 356. Aperture 360 may be about one-quarter inch in diameter.

A ring-shaped section 358 of the lower layer 38' surrounding aperture 360 may be replaced with a non-porous material, such as a fluoroelastomer material, such as VITON™ from Dupont of Wilmington, Del. The non-porous material of ring-shaped section 358 prevents the fluid flowing through aperture 360 from seeping into the porous material of lower layer 38'.

Returning to FIG. 9, a controller, such as a programmed computer 310', is appropriately connected to valve 352. The computer 310' may be operated to open or close valve 352 to control the flow of fluid through aperture 360. When valve 352 is opened, fluid flows through the aperture and applies an upward force to the substrate on the polishing pad. The pressure of the fluid is selected to be the minimum necessary to reliably dechuck the substrate. The pressure may be about twenty psi.

To lift substrate 10 from polishing pad 32, carrier head 100 moves substrate 10 so that the substrate is positioned above aperture 360. The substrate may be positioned so that the opening is about one-half or one-quarter of an inch from the edge of the substrate. The valve 352 is opened so that fluid flows out through aperture 360 and creates an upward force on the substrate. After valve 352 is opened, computer 310' causes carrier head 100 to vacuum chuck substrate 10 to bottom surface 130. Then, air is pumped out of pressure chamber 144 to retract base assembly 104 and lift substrate 10 away from polishing pad 32. The combined upward forces from the vacuum-chucking and the fluid flowing through the aperture are sufficient to overcome the surface tension of the slurry so that the carrier head may lift the substrate away from the polishing pad. In addition, as the substrate is lifted, the fluid fills the space between the polishing pad and the substrate, to prevent the formation of a vacuum therebetween. Thus, the fluid allows the substrate to be gently detached from the polishing pad.

The substrate dechucking mechanism overcomes any surface tension created by the slurry by lifting an edge of the substrate. This ensures that the substrate may be removed from polishing pad by retraction of the carrier head. Thus, the reliability of polishing apparatus 20 is improved.

The present invention has been described in terms of a preferred embodiment. The invention, however, is not limited to the embodiment depicted and described. Rather, the scope of the invention is defined by the appended claims.

What is claimed is:

1. A chemical mechanical polishing apparatus, comprising:

a platen having a passageway therein;

a polishing pad positionable on the platen, the polishing pad having an aperture coupled to the passageway;

a fluid source coupled to the passageway to provide a fluid through the aperture, and to apply an upward force to a substrate on the polishing pad;

a carrier head having a movable mounting surface to which the substrate may be chucked; and a controller operable to move the mounting surface of the carrier head away from the polishing pad as the fluid flows through the passage and the aperture in the polishing pad to lift the substrate from the polishing pad.

2. The apparatus of claim 1 wherein the polishing pad includes an upper layer and a lower layer, with the aperture passing through the upper layer and lower layer, and wherein the lower layer includes a non-porous insert surrounding the aperture.

3. The apparatus of claim 1 wherein an inner surface of the passageway is coated with a polyvinylidene fluoride material.

4. The apparatus of claim 1 wherein the fluid is a liquid selected from the group consisting of substantially pure de-ionized water and an aqueous solution of potassium hydroxide.

5. The apparatus of claim 1 wherein the fluid source includes a pump.

6. A method of removing a substrate from a polishing pad in a chemical mechanical polishing apparatus, comprising:

positioning a substrate above an aperture in a polishing pad located on a platen;

flowing a fluid through the aperture in the polishing pad to apply an upward force to an underside of the substrate;

chucking the substrate to a mounting surface of a carrier; and lifting the mounting surface of the carrier away from the polishing pad during the flowing step.

7. The method of claim 6, wherein flowing a fluid through the aperture includes pumping a liquid selected from the group consisting of substantially pure de-ionized water and an aqueous solution of potassium hydroxide through the passage and the aperture.

8. The method of claim 6, wherein the aperture is located approximately at the center of the polishing pad and the method further comprises moving the substrate so that it overlies the aperture.

9. The method of claim 6, wherein an edge of the substrate is positioned over the aperture.

10. The apparatus of claim 1, wherein the passage includes an opening to an upper surface of the platen, and the aperture of the polishing pad is located over the opening.

11. The apparatus of claim 10, wherein the opening is located approximately at the center of the platen.

12. A method of removing a substrate from a polishing pad in a chemical mechanical polishing apparatus, comprising:

positioning a substrate above an aperture in a polishing pad located on a platen;

flowing a fluid through the aperture in the polishing pad to apply an upward force to an underside of the substrate;

attaching the substrate to a carrier; and lifting the carrier away from the polishing pad during the flowing step.

13. A chemical mechanical polishing apparatus, comprising:

a platen having a passageway therein, the passageway configured to be coupled to an aperture in a polishing pad when the polishing pad is positioned on the platen;

a fluid source coupled to the passageway to provide a fluid through the aperture, and to apply an upward force to a substrate on the polishing pad;

a carrier head having a movable mounting surface to which the substrate may be attached; and a controller operable to move the mounting surface of the carrier head away from the polishing pad as the fluid flows through the aperture in the polishing pad to lift the substrate from the polishing pad.

* * * * *

UNITED STATES PATENT AND TRADEMARK OFFICE

CERTIFICATE OF CORRECTION

PATENT NO. : 5,899,801

DATED : May 4, 1999

INVENTOR(S) : Tolles et al.

It is certified that error appears in the above-identified patent and that said Letters Patent is hereby corrected as shown below:

On the title page, item [56]:

In References Cited,

U.S. PATENT DOCUMENTS,

Insert --5,658,190 8/1997 Wright et al. 451/288--.

Signed and Sealed this

Thirtieth Day of November, 1999

*Attest:*

*Attesting Officer*

Q. TODD DICKINSON

*Acting Commissioner of Patents and Trademarks*